US005521055A

United States Patent [19]

Rider

[11] Patent Number: 5,521,055

[45] Date of Patent: May 28, 1996

[54] PHOTOGRAPHIC PROCESSING

[75] Inventor: Christopher B. Rider, Surrey, United Kingdom

[73] Assignee: Eastman Kodak Company, Rochester, N.Y.

[21] Appl. No.: 190,082

[22] PCT Filed: Jul. 29, 1992

[86] PCT No.: PCT/EP92/01713

§ 371 Date: Feb. 1, 1994

§ 102(e) Date: Feb. 1, 1994

[87] PCT Pub. No.: WO93/03415

PCT Pub. Date: Feb. 18, 1993

[30] Foreign Application Priority Data

Aug. 1, 1991 [GB] United Kingdom ..... 9116624

[51] Int. Cl.[6] ..... G03C 5/00; G03C 3/00; G03C 5/18; G03C 5/26

[52] U.S. Cl. ..... 430/398; 430/399; 430/400; 430/30; 354/298

[58] Field of Search ..... 354/298; 430/30, 430/398, 399, 400

[56] References Cited

U.S. PATENT DOCUMENTS

| | | | |
|---|---|---|---|
| 4,680,123 | 7/1987 | Wernicke et al. | 430/399 |
| 4,881,095 | 11/1989 | Shidara | 354/298 |
| 4,988,448 | 1/1991 | Woog | 430/399 |

FOREIGN PATENT DOCUMENTS

| | | | |
|---|---|---|---|
| 0348512A1 | 1/1990 | European Pat. Off. . | |
| 0381502A1 | 8/1990 | European Pat. Off. . | |
| 1572094 | 1/1970 | Germany | 430/30 |
| 60-194446 | 10/1985 | Japan | 430/30 |
| 1439502 | 6/1976 | United Kingdom | 430/30 |
| 2005566A | 4/1979 | United Kingdom . | |

*Primary Examiner*—Charles L. Bowers, Jr.
*Assistant Examiner*—J. Pasterczyk
*Attorney, Agent, or Firm*—Sarah Meeks Roberts; J. Lanny Tucker

[57] ABSTRACT

In photographic processing apparatus, by-products are produced due to the chemical reactions which occur during the processing of photographic materials. It is known to remove some of these by-products in accordance with the area of photographic material processed and a knowledge of the average level of production of the by-products. This leads to inaccuracies in maintaining a fixed level of the by-products in the processing solutions. Described herein is a method of controlling a subsystem which removes by-products from the processing solutions by using data relating to the exposure given to a photographic material in the printing stage of the processing apparatus to calculate the amount of by-products produced so that they can be exactly removed from the processing solutions.

20 Claims, No Drawings

PHOTOGRAPHIC PROCESSING

This invention relates to improvements in or relating to photographic processing.

It is common practice in photofinishing laboratories to use a densitometer to measure the optical transmission and reflection densities of test strips of photographic materials which have been exposed to a well defined given level. These test strips are used to provide data with which the process, in both paper and film processors, is kept under control.

Many printers, particularly the more sophisticated ones which may be left unattended while working, are equipped with multipixel film scanners. These scanners are effectively high resolution densitometers which are capable of yielding density data which is later used by the exposure control algorithm of the printer to calculate the required exposure which must be given to the print being made from the negative being scanned.

It is known in the industry that a separate scanner may be attached to the end of either the film processor or paper processor, especially for black-and-white materials. This scanner is used to perform process control based on the density of the processed material.

It has also been realized that the printer's scanner is effectively an on-board densitometer which can be used to effect process control measurements from process control test strips. This saves the extra expense of having a separate densitometer in the laboratory solely for the purpose of measuring test strips. Some commercially available printers take advantage of this fact.

Currently the paper processor and printer form one unit in minilabs with the film processor separate. More recently, processing apparatus are appearing in which the film processor, printer and paper processor are integrated into one unit. This new type of apparatus are very close to true "coin-slot" operation where a non-skilled customer could simply place his film in a receptacle, place his money in the slot and then receive his prints and processed film a short while later.

In the following discussion, all examples given will refer to colour photographic systems unless otherwise stated.

Two broad types of chemical reaction take place in a photographic process, namely:

(1) those which are in some way dependent on the amount of image formed on the exposed material; and (2) those which are independent of the amount of image formed on the exposed material.

Development is a good example of the first type of chemical reaction, and can be referred to as being "image-dependent". The amount of developer molecules used up in processing a piece of photographic material is related to the amount of latent image formed on it for given development conditions. Another example of an "image-dependent" chemical reaction is the bleaching process.

Fixing, on the other hand, is an example of an "image-independent" chemical reaction. All the silver in the photographic material is removed in a fixer bath and this amount is essentially the same regardless of the amount of exposure given to the material.

In addition, we may recognise two classes of chemical constituent of a seasoned process solution, namely:

a) those which are produced as a by-product of the reaction, such as halide ions or unreacted molecules of oxidized developer in the developer solution, and b) those which are depleted as a result of the reaction, such as the thiosulphate ion in the fixer.

The replenishment of chemicals which are depleted in a reaction which is "image-independent" may be accomplished by a measure of the area of the photographic material being processed. This is the case with fixers where all the silver is removed from the material and is complexed with thiosulphate ion. Replenishment of thiosulphate in the fixer is easily achieved by knowing what area of film or paper has been processed and the amount of silver per unit area of the material being processed. This technique is well-known in the industry and has been used for a long time.

Current industry practice for the replenishment of developers in processing apparatus is to use a signal derived solely from the area of material passing through the developer to control pumps metering the flow of developer replenisher from a holding tank into the developer bath. It is assumed that all material being developed has been exposed to the same average level. The replenisher system therefore adds D ml of developer replenisher per unit area of material passing through the developer, where D is an amount recommended by manufacturers from experience. This system gives satisfactory performance in processing apparatus with large tank volumes but performs less well in small tanks.

A recent trend in the photographic industry is the production of small minilabs which take up very little space. Some companies make small colour photocopiers which produce copies on photographic paper and desk top models are becoming an increasingly likely possibility. It is expected that these machines will suffer from inaccurate replenishment of the developer if the current system of replenishment is used.

EP-A-0 381 502 describes a method of controlling developer replenishment in paper processing apparatus by deriving a signal from the exposure given to the paper by the printer, using that signal to calculate the quantity of dye which will be formed on the print after processing, and hence calculating the amount of developer used up. The developer is then replenished accordingly.

A further problem which has been encountered in the industry is the replenishment or replacement of systems which remove unwanted components from either the processing solutions or from the effluent produced by the processing apparatus.

One such system which is commonly used employs silver recovery cartridges to remove silver from the effluent of the fixing bath. These cartridges include "steel wool" and work on the principle that iron in the "steel wool" is replaced by silver. However, it is often difficult to know when the cartridge needs to be replaced with a fresh one. For this reason two such cartridges are usually put in series and a comparison of the silver concentration in the connection between the two cartridges is made to see when the silver level begins to rise. At this point the operator will deduce that the upstream cartridge is nearing exhaustion and will replace it with the downstream cartridge, the downstream cartridge being replaced with a fresh one at the same time. Although this method works, it requires a measurement to be made (often by unskilled operators), and it is envisaged that more complicated removal systems will be required for processing apparatus in the future, both for process control and for ensuring that effluent conforms with sewer discharge legislation.

Furthermore, it is likely that the measurements required to test the performance of these more advanced removal systems may be difficult, costly and possibly impractical for an unskilled operator working in a clean environment like a shop or an office.

It is therefore an object of the present invention to provide an improved method for controlling and maintaining a subsystem of photographic processing apparatus which effects the removal of an image-dependent chemical component from a processing solution or from the effluent before it is discharged.

According to one aspect of the present invention, there is provided a method of controlling the removal of chemical species which are image-dependent by-products of chemical reactions during photographic processing in photographic processing apparatus, the apparatus including a printing stage in which a film strip is copied on to photographic material and a processing stage, the method including deriving a signal related to the measured exposure given to the photographic material in the printing stage, characterized in that the derived signal is used to control the removal of the by-products produced during processing of the exposed material.

In this specification, the term "film strip" relates to both negative film and reversal film for use in both black-and-white and colour systems.

More specifically, the amount of image formed on the print can be calculated from the transmittance data measured by the printer in the printing stage using the technique as described in EP-A-0 381 502. The amount of image can then be used to calculate the amount of by-products produced due to image-dependent chemical reactions, and hence control a subsystem which effects the removal of such by-products.

In the case of colour materials which use dyes as the image-forming substances, the amounts of some by-products generated are more closely related to the amount of silver which was developed rather than the amount of dye produced. For example, one halide ion is released for every silver ion which is developed. This is true for all manufacturers' products. There will, however, be variations between different manufacturers' materials in the relation between the amount of developed silver and the amount of dye produced after development. Relationships between exposure, developed silver and dye amounts, part of a larger body of information usually referred to as sensitometric data, are readily available from the manufacturers although typical values may be used with little loss in accuracy.

Information relating to the optical and chemical characteristics of photographic materials, such as, spectral sensitivities, dye spectral absorption curves and relationships between optical density, developed silver and exposure, will be termed sensitometric data. From this sensitometric data and the well-known chemical equations governing processing reactions, all of which may be stored in the control system of the photographic processing apparatus, all important parameters concerning the generation of image-dependent by-products may be easily calculated from the measured exposure data using well-known techniques found in any textbook, for example, *"The Theory of the Photographic Process"*, 4th Edition, published by Macmillan.

In accordance with the present invention, only by-products produced in relation to the amount of image formed are to be controlled. By-products which are image-independent are usually controlled using the well known principle of measuring the area of photographic material processed.

The method described herein uses a signal derived from the photographic printer which exposes the photographic material such that it relates directly to the amount of exposure given. This signal is then transmitted down a link to the processor where it is converted and used to control the replenishment and removal systems built into the processor. Additionally, the control of these systems will also require other information such as development time and temperature of the solutions. These parameters are normally readily available in most commercial processors.

For a better understanding of the present invention, the removal of halide ions from the developer bath will be considered by way of example.

Halide ions are produced in the developer bath as a by-product of the development reaction. The quantity of halide ions produced is related to the exposure given to the photographic material being processed. Since halide ions act as a restrainer for the reaction, it is desired to keep their concentration at a predetermined level so as to maintain constant processing solution activity.

In this example, the processing apparatus incorporates a subsystem which has the ability of removing halide ions from the processing solution, the ions being removed by passing the processing solution over a coated substrate to which the halide ions bind very strongly. For the purposes of this example, the reaction kinetics are sufficiently fast so that the halide ions are bound to the substrate much faster than they are produced in the developer. For a desired concentration of halide ions in the developer of H moles per liter, and a piece of photographic material which will produce h moles of halide ions (evenly distributed throughout the solution) when processed, the volume of liquid, v, can be calculated for which h moles of halide ions are present and where the total solution volume before development is V. Normally, photographic materials carry out a small amount of liquid with them as they pass from one bath to another, and if it is assumed that the solution volume carried out of the developer by the photographic material is c liters, the following equation is obtained:

$$v=h(v-c)/(HV+h)$$

If volume, v, of liquid is removed from the developer and passed through the removal system for sufficient time to remove all the halide ions before it is added back into the solution, the halide concentration in the developer may be kept constant. The parameters H, V and c are known constants and h may be calculated from a knowledge of the exposure given to the photographic material, and hence v may be calculated. Thus a flow controller may be operated to dispense v liters of liquid into the halide removal system. This example demonstrates how exposure information can be used to control the operation of the removal system.

It is noted that h is a function of the exposure given to the material, and may be determined from the sensitometric data relating to the photographic material which is stored in the processing apparatus. Specifically, the relation between exposure and developed silver would be used, since the number of halide ions released into the developer solution is identical to the number of silver ions developed to form metallic silver.

If the capacity of the removal system is R moles of halide ions, it is a simple matter to predict when it will be exhausted. If T is the volume of solution which can be treated:

$$T=Rv/h$$

Thus the operator may be automatically alerted when action needs to be taken to change or replenish a removal system cartridge.

In all the discussion above, the exact form of the relation between halide ions released and exposure is not the key issue, as it merely serves to illustrate the principle that a calculation is possible. Neither is it necessary to use a "batch type" removal system as described above. A more complicated, continuous flow system may be used, provided its characteristics are well-known and that accurate flow-measurement is possible.

Furthermore, the exact relation between measured exposure and the amount of any by-product generated during processing may be determined experimentally using techniques familiar to any one skilled in the art of printing and processing. Look-up tables of this empirical data may then be used by the control system of the processing machine to control the removal subsystems built into it.

In the above discussion, it has been assumed that for every copy made from images on the film strip on to the photographic material in the printer, a measure of the exposure would be made for the purpose of controlling the removal systems in the processor in response to the by-products generated in processing each copy. This represents an ideal situation. For reasons of practicality, it may be preferable to accumulate the measured exposure from a batch of copies and perform actions to control the removal systems after each batch of copies has been processed.

For example, some minilab printers expose a number of prints and then process them batchwise. In the case of high speed printers, a whole roll of prints would be exposed and stored before being transferred to a processing machine.

For reasons explained in EP-A-0 381 502, it may prove to be most effective, especially when the printer and processor are physically separated, for measured exposure data to be recorded on the back of each print in some coded form, for example, a bar code or punched holes, to be read by the processing machine at the time of processing, and used for controlling chemical replenishment as described in EP-A-0 381 502, or, as in this case, chemical removal systems. The exposure data may also be stored on a separate medium, such as a magnetic disk, and then transferred to the processor with the prints. It would then be read by the processor while the prints are being processed.

Another variant on the present invention is to use a combination of replenishment by area and replenishment by calculation. In this case, the processor would normally replenish according to the area of paper processed using an average value per unit area for the replenishment rate (subsequently referred as an "area-dependent" value). At the same time it would continually calculate the correct amount of replenishment based on measured transmittance values of images to be copied and obtain a difference between the calculated and actual replenishment rates. When the accumulated difference between the two replenishment rates exceeds a threshold level, a correction is made to the actual replenishment rate based on the accumulated difference. For example, in the case of removal of halide ions, when the printer, based on calculation of the halide ions released during processing, had accumulated a correction to the normal removal rate greater than a threshold level, it would effect the appropriate correction at the next opportunity. This correction could, of course, be either a positive or negative amount.

Another important consideration is the spatial resolution of the exposure measurement made in the printer. Printers which use discrete photocells for determining exposure measure only the average transmittance of the film strip. In the case of a negative, a subject comprising a white spot against a black background would print as a black spot on a white background. The black spot would have reached the maximum density the photographic material, in this case photographic paper, could give. The amount of dye in the spot would therefore be less than that expected from a calculation based on the average transmittance of the negative. Consequently, the calculated amount of by-products generated in processing would be too great.

This can be overcome by the use of a higher resolution measurement of the transmittance of the negative. A scanning device, for example, a charge-coupled device having a 30 by 20 array would yield 600 measurements of the transmittance of the negative. Areas of low density on the negative which would give an area of $D_{max}$ on the print could be recognized as such, by using the paper's reflection density versus log(exposure) curve provided by the manufacturer. The dye amounts formed at each of the 600 areas could be added together to give an accurate calculation of the total dye amount formed on the print.

The ultimate extension of this technique would be to apply it to a scanning printer where the negative is scanned at very high resolution.

The method according to the present invention is applicable to any removal system used in photographic processing apparatus whether it be based on chemical binding, as above, or ionic replacement as in ion-exchange columns and silver recovery cartridges or any other method where an element of the system is either exhausted or needs replenishing with reagent.

This method has the advantage that an indication can be given to an operator when a removal system is nearly exhausted. This enables maintenance to be carried out at the right time and without the need for routine measurements by the operator. Sometimes it is very difficult for an unskilled operator to make these measurements especially where they are concerned with effluent discharge limits which may be very low.

Another advantage of this method is that automatic replenishment of removal systems may be achieved such that their removal efficiency is maintained at a constant level.

For example, a liquid reagent which reacts strongly with the halide ions may have been chosen to cause the ions to precipitate out of the solution as an alternative to using a solid substrate to which the halide ions bind. In this case, the removal system may comprise a separate reaction vessel in which known amounts of developer solution are added to the liquid reagent. It is clear that the liquid reagent would need replenishing from time to time in order to keep its activity high. This replenishment could be controlled by knowing the amount of reagent used up in removing the halide ions. This amount is related to the amount of halide ions to be removed which, in turn, may be calculated from the amount of exposure given to the photographic material which released the halide ions.

In this above example, the liquid is reagent is the consumable component.

Therefore, it can be seen that in addition to controlling the operation of removal systems for image-dependent chemical species, the present invention may also be used to control the replenishment of the removal system itself.

In the case of non-replenished removal systems, the present invention can be used to predict exhaustion of the removal system and provide a signal to alert an operator or an automatic system to take the necessary maintenance actions. For example, in an automatic system, the signal causes an actuator to switch over from a nearly-exhausted removal system to a fully replenished system connected in parallel.

Furthermore, control of the concentration of components of the process produced as by-products of chemical reactions which are image-related can be provided without the need for chemical sensors being present in the processing solution.

Moreover, for chemical species for which no convenient chemical sensor exists, the method of the present invention makes process and environmental control possible for the first time.

In the minilab environment, where each negative is measured automatically before it is printed, the exposure data may be easily obtained with no extra hardware cost and with only a small software overhead. The link between printer and processor is already there.

Naturally, other "image-dependent" by-products can also be removed using the method according to the present invention—in particular, oxidized developer molecules.

I claim:

1. A method of controlling means for removing image-dependent by-products of chemical reactions produced during processing of silver halide photographic material in a photographic processing apparatus, the apparatus including an exposing section in which an image to be copied is exposed onto the photographic material and a processing section for processing the exposed photographic material, the method including the steps of:

deriving a signal related to the exposure given to the photographic material during exposure in the exposing section; and using the derived signal to control said means for removing the by-products produced during processing of the photographic material.

2. A method according to claim 1, wherein the derived signal is used to calculate the amount of by-products produced during processing of the exposed material.

3. A method according to claim 1, wherein the by-products are ions.

4. A method according to claim 3, wherein the ions are halide ions.

5. A method according to claim 1, wherein the by-products are molecules.

6. A method according to claim 5, wherein the molecules are oxidized developer molecules.

7. A method according to claim 1, wherein said means for removing includes reagents used for effecting the removal of the chemical species which are image-dependent by-products of chemical reactions produced during processing of the silver halide photographic material in the photographic processing apparatus and the derived signal is used to control the rate of replenishment of the reagents in said means for removing.

8. A method according to claim 7, wherein the derived signal is used to calculate the level of depletion of the reagents.

9. A method according to claim 8, wherein the calculated level is used to provide a first signal to indicate near-exhaustion of the said means for removing.

10. A method according to claim 9, wherein said means for removing comprises a first removal apparatus and a second removal apparatus and a first signal indicating near-exhaustion is used to switch between said first removal apparatus and said second removal apparatus.

11. A method according to claim 1, wherein the signal is derived from measurements of the average transmittance of the image to be copied.

12. A method according to claim 1, wherein the signal is derived from measurements of the average transmittance of a plurality of different small areas of the image to be copied.

13. A method according to claim 11, wherein the signal is derived-from the sum of measurements of the average transmittance of a batch of images to be copied onto photographic material at the exposing section.

14. A method according to claim 11, wherein the signal is further derived from data relating to the sensitometric characteristics of the photographic material.

15. A method according to claim 1, wherein the derived signal is related to the amount of by-products to be removed by an empirical function.

16. A method according to claim 1, wherein the derived signal is used to provide a correction to other control signals derived solely from a measurement of the area of the photographic material which has been processed.

17. A method according to claim 1, wherein said means for removing comprises a flow controller for controlling flow of a processing solution from said processing section to said means for removing, the derived signal being utilized to control the flow from the flow controller.

18. A method according to claim 17, wherein said means for removing further comprises a solid substrate over which processing solution is directed, the by-products binding to the substrate for removal from the processing solution.

19. A method according to claim 18, wherein said means for removing operates in a batch mode.

20. A method according to claim 18, wherein said means for removing operates in a continuous mode.

* * * * *